United States Patent [19]

Honea, Jr.

[11] 3,960,357

[45] June 1, 1976

[54] FORM SUPPORT MEANS FOR USE WITH PERFORMED GIRDERS

[75] Inventor: William S. Honea, Jr., Kenner, La.

[73] Assignee: T. L. James Company, Inc., Kenner, La.

[22] Filed: Feb. 20, 1974

[21] Appl. No.: 444,142

[52] U.S. Cl. ..... 249/211; 249/24

[51] Int. Cl.[2] ..... E04G 17/18

[58] Field of Search ..... 249/13, 18–19, 249/23–25, 28–32, 211; 14/1; 248/351, 354, 357; 182/182–184

[56] References Cited

UNITED STATES PATENTS

| | | | |
|---|---|---|---|
| 1,291,324 | 1/1919 | Widmer | 249/29 |
| 3,047,931 | 8/1962 | Boettner | 249/192 |
| 3,161,703 | 12/1964 | Watson | 249/19 |
| 3,504,879 | 4/1970 | Strickland | 249/219 R |
| 3,628,765 | 12/1971 | Sanders | 249/19 |

FOREIGN PATENTS OR APPLICATIONS

| | | | |
|---|---|---|---|
| 328,959 | 8/1935 | Italy | 249/23 |
| 343,114 | 1/1960 | Switzerland | 249/23 |
| 327,629 | 2/1958 | Switzerland | 249/28 |

*Primary Examiner*—Robert D. Baldwin
*Assistant Examiner*—John McQuade
*Attorney, Agent, or Firm*—Pugh & Keaty

[57] ABSTRACT

An improved deck form supporting system for supporting sectional floor forms between bridge girders, for example concrete girders on top of which floor forms cementitious material is poured to form a concrete floor. The novel supporting system is located below the sectional floor forms and includes a series of evenly spaced wedges, usually triangular in shape, placed along the lower inclined or slanted surfaces of the suppoting girders (FIG. 4) along with a series of "L" shaped brackets which mate with the horizontal and vertical surfaces of said wedges (FIG. 5), the brackets having vertical and horizontal tubular extensions having jackscrew sections therein, the combination being used to support on "U" shaped shoring brackets (FIG. 3) horizontally, laterally disposed forming members placed between the bridge girders (FIG. 2) to support the floor forms.

7 Claims, 6 Drawing Figures

FORM SUPPORT MEANS FOR USE WITH PERFORMED GIRDERS

BACKGROUND OF THE INVENTION

The present invention relates to a deck forming supporting system for supporting sectional floor forms between girders, for example concrete bridge girders, on top of which floor forms cementitious material is poured to form a concrete floor. The present invention has been found to be particularly useful in the deck form support art for making bridges, especially as the device for supporting horizontally disposed forming members laterally placed between the bridge girders through the use of shoring brackets, and hence will be discussed with particular reference thereto.

In the construction of reinforced concrete bridges, a concrete deck is formed integrally with a set of longitudinally disposed bridge girders, usually made of concrete. The deck is layed by pouring concrete on reinforcing rods onto forms which are placed between adjacent bridge girders. The forms have to be placed so that the deck is integrally connected to the girders and has a substantially uniform thickness throughout its length. Thus it is necessary to securely and accurately position the forms. The longitudinally disposed bridge girders are usually "I" beams having lower inclined or slanted surfaces or lower squared off surfaces.

Several types of deck form supporting devices and methods have been known and used before, and typical examples thereof in the form supporting art are shown in U.S. Pat. No. 3,504,879, issued Apr. 7, 1970 to James K. Strickland, U.S. Pat. No. 3,626,648 issued Dec. 14, 1971 to Joe W. Beckham, U.S. Pat. No. 3,047,931 issued Apr. 21, 1961 to J. L. Boettner, U.S. Pat. No. 3,239,188 issued Mar. 11, 1964 to Peter Eric Gostling, U.S. Pat. No. 949,093 issued Feb. 15, 1910 to George H. Sherwood, U.S. Pat. No. 642,972 issued Feb. 6, 1900 to Charles Frolich, U.S. Pat. No. 2,215,972 issued Sept. 24, 1940 to Henry Mueller et al, U.S. Pat. No. 2,041,311 issued May 19, 1936 to Charles H. Walker, U.S. Pat. No. 2,122,276 issued June 28, 1938 to George B. Bosco, and U.S. Pat. No. 2,234,335 issued Mar. 11, 1941 to Hubert H. Ecterling.

Most of the prior art approaches use some type of hanging system wherein the forms are supported by means of hardware placed over the girder and which extend down through the wooden form supports. For example the Mueller and Boxcoe support devices, as shown particularly in their FIG. 2, were attached over the top of the girder were immersed in the concrete upon completion thereby losing a substantial amount of hardware, and were adapted only to steel "I" beams. The Walker support device as shown particularly in FIG. 1 was also attached over the top of the girder and was also adapted only to steel "I" beams.

Other prior art approaches use support systems which physically clamp to the lower portion of the basic support girders; a typical example of this type being the Ecterling device as shown particularly in FIG. 1. 1 and 3, constitutes a shoring bracket and jack of the same general type used in the present invention for supporting the struts of the forming support but where attached directly to the supporting bridge girders by drilling or special forming of the concrete bridge girders. The Boettner device as shown particularly in FIG. 1 also constitutes a shoring bracket and jackscrew of the same general type used in the present invention but shows no method of support of said jacks. The commercial undesirability of overhead systems such as Mueller, Bosco, and Walker was apparently appreciated, however in the Boettner device which was attached from below. The Gostling device as shown particularly in FIG. 1 also shows a jackscrew of the same type used in the present invention which supports the floor forms from below but does not use the same shoring bracket as the present invention and shows no method of support of said jackscrews.

The Frolich and Sherwood devices, as shown particularly in FIGS. 1 and 2, respectively, show a forming support system which rests on the inclined surface at the bottom of the basic girder supports, the forming support system however being adjustable both in height and width only in a rather complex manner.

In contrast to the prior art which teaches support systems that have many problems such as requiring especially constructed concrete girders; ties, clamps, wedges, bolts, etc. that are lost in the concrete and cannot be recovered; and complex, hard to construct, adjust and dismantle lower support systems; the present invention utilizes a very simple, flexible and reliable design. The present invention in its preferred embodiment utilizes a wedge placed along the lower inclined surfaces of the basic girders connected in the horizontal and vertical directions by the use of an "L" shaped bracket to tubular extensions having jackscrew sections therein. In this manner it supports the struts of the forming support from below permitting ease of assembly and disassembly of the system and permitting recovery of all of the parts of the system supporting the section floor forms for reuse as a unit without even requiring disassembly and reassembly of the component parts of the system.

The present invention utilizes a shoring bracket at the end of the vertical supports of rigid construction which is easily operated because of its stability. Individual brackets may be selected to fit any size beam. Additionally, the horizontal and vertical jackscrews permit adjustability for both horizontal supports and spacing beween the supporting bridge girders independently to compensate for small misalignment in either supporting bridge girder. The vertical jackscrews permit easy adjustability to any height for deck level. Furthermore, the shape of the wedge is adaptable to be used on either side of the support girder.

Additionally, because the shape of the wedge can be varied, it can be used with steel beams as well as reinforced concrete beams.

Finally, because the invention uses the wedge to convert vertical force vectors into horizontal force vectors, the invention does not require special cement castings for the bridge girders, drilling into the concrete, or inserts into the deck.

BRIEF DESCRIPTION OF THE DRAWINGS

For a further understanding of the nature and objects of the present invention, a reference should be had to the following detailed description, taken in conjunction with the accompanying drawings, in which like parts are given like reference numerals and wherein.

DETAILED DESCRIPTION OF THE PREFERRED EMBODIMENT

Introduction

The deck form supporting system of the preferred embodiment may be used to support deck forms of any sort wherein it is important that easy assembly and disassembly be accomplished and where misalignments in the horizontal and vertical directions may be present. A particularly important area of application of the present invention is in deck form supporting in the construction of highway bridges using concrete girders, and therefore the preferred embodiment will be described with respect to such an application.

In the preferred embodiment of the present invention, the support of the sectional floor forms is accomplished through the use of a plurality of evenly spaced triangular wedges, of wood or suitable material. The wedge should be of suitable width (e.g six inches) for stability with no weight applied when positioned along the lower inclined surfaces of the concrete supporting girders, along with a series of "L" shaped brackets which mate with the horizontal and vertical surfaces of the wedges, the brackets having vertical horizontal tubular extentions. Therefore, when weight is applied to the vertical tubular extensions using them as vertical shoring by placing horizontally disposed support members on them, the vertical force vector of the weight of the member is translated by the wedge on each side of the horizontally disposed support member into components of vertical and horizontal forces to stabilize the system and support the weight of said members. In the same manner, the subsequent application of the longitudinal forming members, deck form and the cementitious material will add additional weight and be stabilized by translation and distribution of the vertical force vector of such weight by the wedges to the fixed concrete girders.

STRUCTURE AND ITS METHOD OF USE

Figure 2:
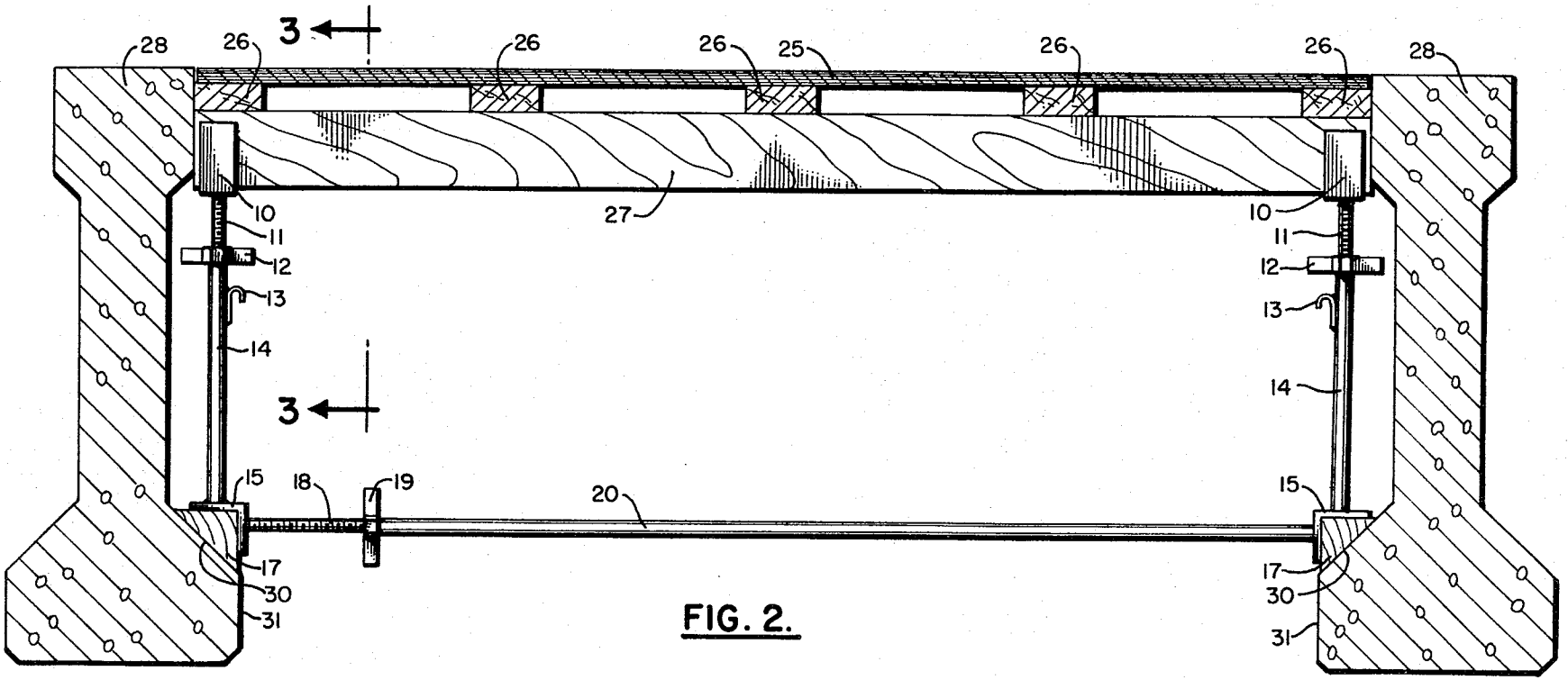
FIG. 2 is a longitudinal, end view of the preferred embodiment of the deck form supporting system showing all of the component parts supporting the sectional floor forms between two parallel bridge girders.
Figure 4:
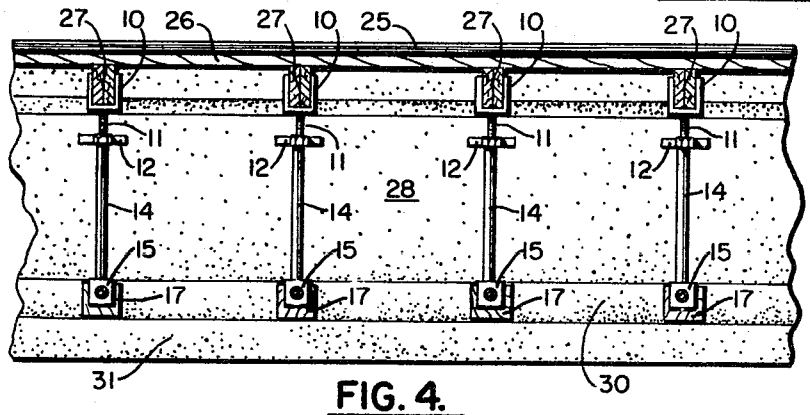
FIG. 4 is a lateral, side, cross-sectional view of the preferred embodiment of the deck form supporting system, showing a multiplicity of deck form supporting devices, taken along section lines 4—4 of FIG. 2.
Figure 3:
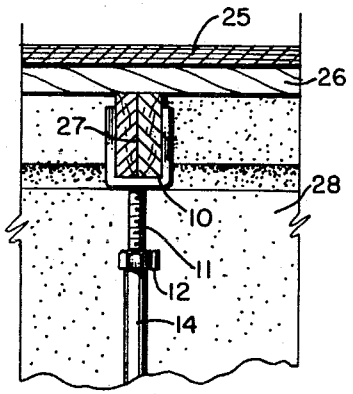
FIG. 3 is a partial, cross-sectional view of the preferred embodiment of the deck form supporting system taken along section lines 3—3 of FIG. 2.

Referring particularly to FIGS. 2 and 4, there is shown a typical reinforced concrete bridge girder system wherein a plurality of evenly spaced support brackets 10 support a plurality of lateral, horizontally disposed forming members 27 placed between concrete bridge girders 28. The forming members 27 are used to support a plurality of longitudinal members 26. Form boards 25 are then laid upon the longitudinal members 26, which is further detailed in FIG. 3. It will be understood that a sufficient number of form boards 25 will be laid to cover the entire floor area on which the concrete is to be poured to form the deck slab.

U-shaped support brackets 10 are attached by welding or other suitable means to vertically oriented jackscrews composed of threaded screw shafts 11 with wing nuts 12 threaded thereon and vertical, tubular shafts 14, the top portion of the shafts 14 being suitably dimensioned to loosely mate with the threaded shafts 11. The vertical shafts 14 are attached to "L" shaped brackets 15 by welding or other suitable means.

Figures 1, 5, 6:
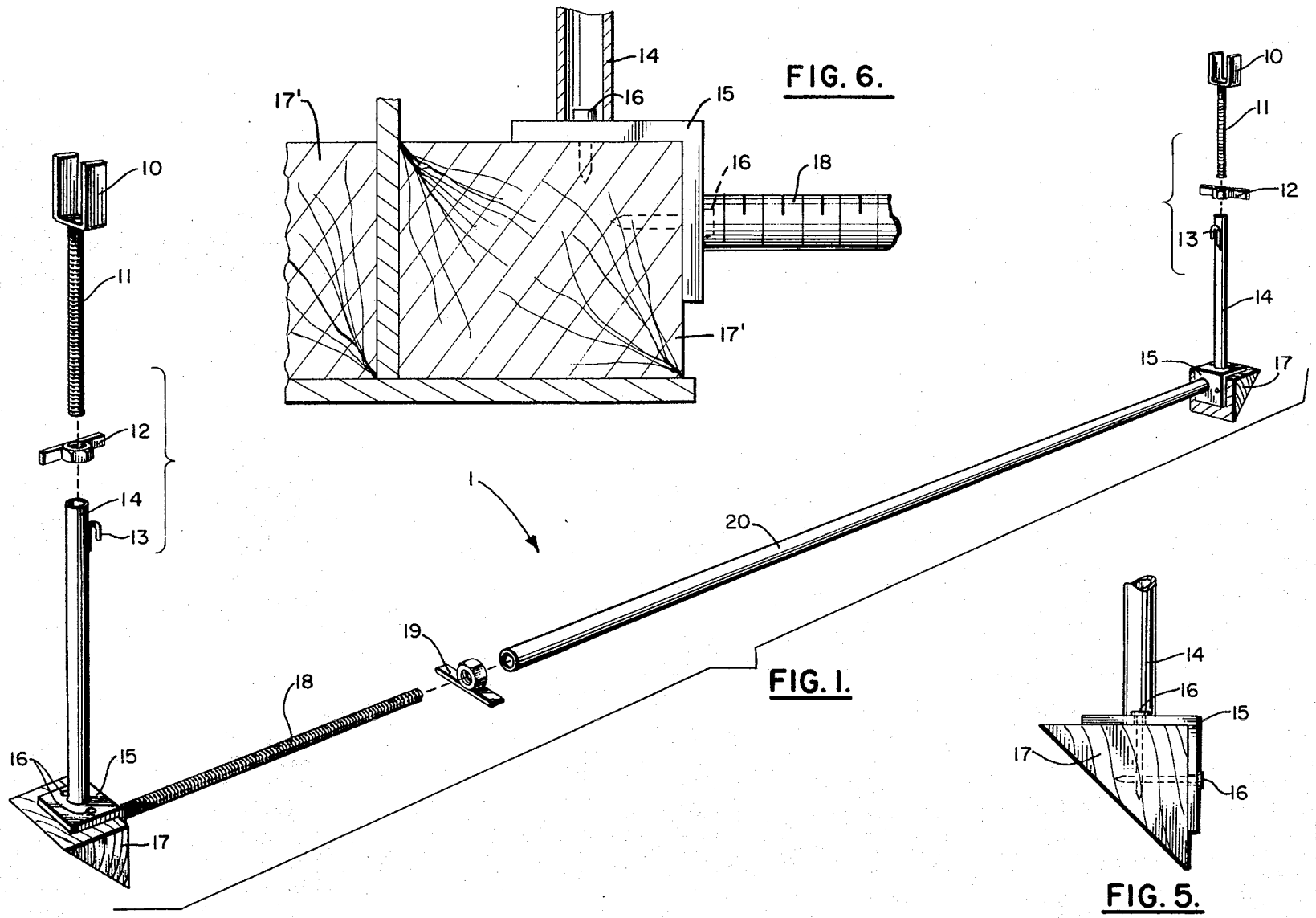
FIG. 1 is a perspective view of the preferred embodiment of the deck form supporting system of the present invention showing the major component parts thereof, some of which are in exploded array.
FIG. 5 is a side, partial view of the preferred embodiment of the deck form supporting system showing the triangularly shaped wedge connected in the vertical direction of the "L" shaped bracket and vertical tubular extensions.
FIG. 6 is a side, partial view of an alternate embodiment of the deck form supporting system showing the square shaped wedge connected in the vertical direction of the "L" shaped bracket and the vertical tubular extensions.

The "L" shaped brackets 15 also have attached to them one side of the horizontally oriented screw assemblies 1, either the threaded shaft 18 or the tubular shaft section 20 depending on which direction the wedge is to face, as shown in FIGS. 1 and 2. The end of the shafts 20 which are not connected to the "L" shaped brackets 15 are suitably dimensioned to loosely mate with the threaded shafts 18, the depth of the extension of the threaded shafts 18 into the shafts 20 depending of course on the position of the wing nuts 19 threaded thereon.

The "L" shaped brackets 15 are also connected to suitably shaped triangular wedges 17 by means of a set of nails 16 driven into both the horizontal and vertical surfaces of said wedges 17, which is further detailed in FIG. 5.

In FIG. 2, the wedges 17 are shown as they are attached by force from the jackscrew 1 to the concrete girders 28. The beveled surface of the wedges 17 (hypotenuse of the right triangle formed by the wedge) are faced against the lower inclined or slanted surfaces 30 of the concrete girders 28. The surfaces of the concrete girders 28 again become vertical after they have been swedged out by means of teh inclined surfaces 30.

After the assembly of each support unit, which consists of the components shown in FIG. 1, has been made, it is raised into position for connection to the concrete girders 28 by means of hooks 13.

In summary then, in the preferred embodiment of the present invention, the components of FIG. 1 are assembled before any form erection begins. After a sufficient number of such assemblies are completed to support the deck forming through the use of horizontally disposed form members, they are raised by the hooks 13 which are attached to the vertical shafts 14 and placed in an equally spaced manner on the lower inclined surfaces 30 of the concrete support girders 28. The assemblies are then firmly engaged to and locked between the lower inclined surfaces 30 of the concrete girders 28 by use of the horizontally disposed jackscrew assemblies 18, 19 and 20. The horizontally disposed form members 27 are then placed in the brackets 10 and the vertical jackscrew assemblies 11, 12, and 14 employed to properly align said horizontal members 27. Following this, the longitudinal support members 26 can be mounted on the horizontally disposed lateral support members 27. Finally the floor form 25 of for example plywood sheets is laid on the longitudinal support members.

After the concrete has been poured and allowed to set and cure, the system is dismantled by lowering or reducing the vertical and horizontal jackscrew assemblies 11, 12, 14 and 18, 19, 20, respectively, of the individual assemblies. The assembly with the horizontally disposed support members 27 may then be lowered by means of the hooks 13 associated with each assembly. After sufficient assemblies have been removed, the longitudinal support members 26 can also be removed. Finally the floor forms 25 are physically separated from the cement. Thus all of the hardware and forming materials are salvaged for re-use.

Having the system adjustable in the lateral, horizontal direction by means of jackscrew assembly, allows the system to be particularly useful in the building of bridges in the interstate system wherein flaring (variation in girder spacing of the bridge structure) often occurs. The preferred embodiment of the present invention is capable of adjusting for girder spacing between six feet in lateral separation distance. It is noted that in the preferred embodiment no cross bracing is needed between the horizontal and vertical jackscrew assemblies, resulting in a very simple but reliable design. The tubular members 14 can be made of black standard pipe having a one inch inner diameter, while the threaded shafts 11, 18 can be made of one inch diameter rods. When threaded, the rods lose a sufficient amount in their diameters that they can have a good but loose fit with the tubular members.

Although the system described in detail supra has been found to be most satisfactory and preferred, many variations in structure and method are, of course, possible. For example rather than using "U" shaped brackets 10, flat surfaces could be used. Also, instead of using jackscrews, prop attachments could be used. Additionally, the shape of the wedge may be changed from triangular to square, if steel "I" beams are employed, as shown in FIG. 6.

The above are, of course, merely exemplary of the possible changes or variations.

Because many varying and different embodiments may be made within the scope of the inventive concept herein taught and because many modifications may be made in the embodiment herein detailed in accordance with the descriptive requirements of the law, it is to be understood that the details herein are to be interpreted as illustrative and not in a limiting sense.

I claim:

1. A deck form supporting system component for use with a deck forming system including horizontally disposed forming members and floor forms placed above the forming members located between two supporting girders, each of the girders having a lower portion which has a horizontal component to it by being either slanted or horizontally disposed, said component comprising:

two opposed, vertical support assemblies including vertical length means for varying their length to a distance of the order of the distance from the top of one of such supporting girders to its lower portion;

a horizontal support assembly disposed between and in juxtaposition to said opposed vertical support assemblies including horizontal length means for varying its length to a distance of the order of the separation distance between the lower portions of such supportng girders;

two "L" shaped bracket means, one each interconnected between the bottoms of each of said vertical support assemblies and the adjacent end of said horizontal support assembly, for connecting them together at right angles;

dual wedge means placed at the apex of said "L" shaped bracket means for supporting and positioning said "L" shaped bracket means on such horizontal component of such lower portion of such two supporting girders; and bracing means for supporting at opposite ends thereof one of such horizontally disposed forming members, said bracing means being connected to the top of each of said vertical support assemblies, whereby the deck forming system can be supported between the supporting girders by being supported on their lower portions by said bracing means through said vertical support assemblies, said bracket means and said wedge means, which are held apart by said horizontal support assembly.

2. The system component of claim 1 wherein said bracing means includes two U-shaped brackets, each composed of a horizontal member, whose width is as wide or wider than such horizontally disposed forming members, and two vertical members.

3. The system component of claim 1 wherein said vertical length means include a jackscrew.

4. The system component of claim 1 wherein such supporting girders are concrete beams with lower inclined or slanted surfaces, and said dual wedge means are each triangular in shape and of such a width as to provide stability for the component without anything else being physically attached from the component to such girders or such deck forming system.

5. The system component of claim 1 wherein such supporting girders are metal beams with lower, squared off surfaces, and said dual wedge means are square in shape and of such width as to provide stability for the component without anything else being physically attached from the component to such girders or such deck forming system.

6. The system component of claim 1 wherein said horizontal length means includes a jackscrew.

7. The system component of claim 1 wherein there are provided several of said components to form a complete deck form supporting system.

* * * * *